US006270058B1

(12) United States Patent
Williams et al.

(10) Patent No.: US 6,270,058 B1
(45) Date of Patent: Aug. 7, 2001

(54) HANDRAIL/LEANING RAIL

(75) Inventors: Howard J. Williams, Muncy; William L. Bussler, Montoursville, both of PA (US)

(73) Assignee: Construction Specialties, Inc., Lebanon, NJ (US)

( * ) Notice: Subject to any disclaimer, the term of this patent is extended or adjusted under 35 U.S.C. 154(b) by 0 days.

(21) Appl. No.: 09/572,543

(22) Filed: May 15, 2000

Related U.S. Application Data

(63) Continuation of application No. PCT/US99/11104, filed on May 19, 1999.
(60) Provisional application No. 60/086,228, filed on May 21, 1998.

(51) Int. Cl.[7] ..... E04F 11/18
(52) U.S. Cl. ..... 256/59; 256/1; 256/65
(58) Field of Search ..... 403/167, 205, 403/231, 363, 375, 379.3; 256/1, 59, 64, 66, 69, 68, 65; 248/251

(56) References Cited

U.S. PATENT DOCUMENTS

| | | | | |
|---|---|---|---|---|
| 2,807,834 | * | 10/1957 | Blum | 248/251 |
| 3,164,354 | * | 1/1965 | Murdock | 248/251 |
| 3,168,170 | | 2/1965 | Thom . | |
| 3,544,072 | * | 12/1970 | Thom | 256/59 |
| 3,825,229 | * | 7/1974 | Bartlett et al. | 256/59 |
| 3,842,564 | * | 10/1974 | Brown | 256/65 X |
| 4,196,552 | * | 4/1980 | Bartlett | 256/59 X |
| 4,253,287 | | 3/1981 | Overmoe . | |
| 4,353,529 | | 10/1982 | Brown . | |
| 4,646,490 | | 3/1987 | Naka et al. . | |
| 4,899,989 | | 2/1990 | Kitson et al. . | |
| 5,033,244 | | 7/1991 | Ullman . | |
| 5,165,643 | * | 11/1992 | Shreiner | 256/59 X |
| 5,273,258 | * | 12/1993 | Bedics | 256/59 |
| 5,288,048 | | 2/1994 | Shreiner . | |
| 5,326,187 | * | 7/1994 | St. Marie et al. | 403/205 X |
| 5,427,359 | | 6/1995 | Moulton . | |
| 5,469,682 | * | 11/1995 | Knight | 256/59 X |
| 5,529,288 | * | 6/1996 | Cheng-I | 256/65 |
| 5,544,866 | * | 8/1996 | Dye | 256/69 |
| 5,592,786 | * | 1/1997 | Kamm | 256/1 X |
| 5,743,064 | * | 4/1998 | Bennett | 256/66 X |
| 5,908,185 | * | 6/1999 | Collette et al. | 256/59 X |
| 6,009,682 | * | 1/2000 | Lehman et al. | 256/1 X |

FOREIGN PATENT DOCUMENTS

| | | | | |
|---|---|---|---|---|
| 406129065 | * | 5/1994 | (JP) | 256/59 |

OTHER PUBLICATIONS

The C/S Group catalog, Acrovyn® products, pp. 1–31; 1995.

* cited by examiner

*Primary Examiner*—Lynne H. Browne
*Assistant Examiner*—David Bochna
(74) *Attorney, Agent, or Firm*—Baker Botts L.L.P.

(57) ABSTRACT

A handrail/leaning rail includes a mounting system adapted to be attached to a wall and an elongated rail separate from the mounting system and removably attached to the mounting system. The rail has a handgrip portion having a top surface and undercut front and rear surfaces shaped for grasping by a user, the rear surface being positioned on the rail to be spaced apart from the wall. A safety blocking portion that is longitudinally coextensive with the handgrip portion and extends rearwardly from a lower base portion of the rear surface of the handgrip portion blocks a gap that would otherwise be left between the lower base portion of the handgrip portion and the wall. The rail also has a wall shield flange portion that extends upwardly from the safety blocking portion and is spaced apart from the rear surface of the handgrip portion.

27 Claims, 9 Drawing Sheets

HANDRAIL/LEANING RAIL

RELATED PRIOR APPLICATIONS

The present application is a continuation of co-pending International Application Number PCT/US99/11104, filed May 19, 1999, which was published under Number WO 99/60227, is in turn based on U.S. Provisional Patent Application No. 60/086,228, filed May 21, 1998, and is hereby incorporated herein by reference for all purposes.

BACKGROUND OF THE INVENTION

The present invention relates to handrails and, in particular, to a handrail that is configured to enable infirm persons to either grasp it or lean on it for support and to prevent any part of a user's hand or arm from passing through a space between a handgrip portion and the wall to a position below the handgrip portion, should the user lose his or her grip on the handgrip portion.

Hospitals, nursing homes and assisted-living facilities make extensive use of handrails so that infirm persons have something to hold onto when they walk from place to place. The handrails are often designed not only for providing support to infirm persons but for protecting the walls from impacts by food carts, equipment carts, litters and other objects that are moved through the building. As far as the present applicants are aware, all handrail systems commonly used in hospitals and nursing homes have rails that are mounted on brackets that are spaced apart along the wall and support the rails some distance from the wall, thus leaving a gap between the wall and the rail. The gap is usually wide enough to accept the hand and forearm of a person. It is, therefore, possible for a user's hand to accidently slip from grasping engagement with the handgrip and pass through the gap. If the person falls while his or her arm extends into the gap between the handrail and the wall, his or her hand, wrist or arm can be broken.

Some infirm persons are not physically able to get a good grasp on the handgrip of a handrail or not able to grasp the rail at all. Instead, they rest their hand or lean their forearm on the rail for support. Many previously known handrails are not well suited for being leaned on, either because they lack a wide upper surface or the upper surface is spaced widely apart from the wall and can uncomfortably trap or pinch the forearm of the user between the wall and the handgrip portion of the rail or even allow the forearm to pass between the handgrip and the wall.

Another shortcoming of many previously known handrails of the type used in hospitals, nursing homes and assisted-living facilities is an "institutional" or commercial appearance. A pleasant environment contributes to the well-being of the occupants. Attractive special functional fixtures, such as handrails, should have a residential appearance to the extent possible.

SUMMARY OF THE INVENTION

An object of the present invention is to provide a rail—a "handrail/leaning rail"—that can be grasped or leaned on for support. It is also an object to provide a handrail/leaning rail that presents surfaces that are free of discontinuities along the length of the rail that can catch a user's fingers or hand. In addition, it is desired to ensure that a user's hand or forearm cannot protrude though a gap between the handgrip and the wall and be injured. Yet another object is to protect the wall on which the handrail/leaning rail is mounted from impacts by objects such as food and equipment carts.

Furthermore, it is an object of the invention to provide a handrail/leaning rail in which, preferably, the wall surface adjacent the rail is covered by a shield portion of the rail and the rail is attractive in appearance, durable, economical to produce and install, and easy to clean.

The foregoing objects are attained, in accordance with the present invention, by a handrail/leaning rail that includes a mounting system adapted to be attached to a wall and an elongated rail separate from the mounting system and removably attached to the mounting system. The rail has a handgrip portion having a top surface and undercut front and rear surfaces shaped for grasping by a user, the rear surface being positioned on the rail to be spaced apart from the wall. A safety blocking portion that is longitudinally coextensive with the handgrip portion and extends rearwardly from a lower base portion of the rear surface of the handgrip portion substantially blocks a gap that would otherwise exist between the lower base portion of the handgrip portion of the rail and the wall. In preferred embodiments, the rail also has a wall shield flange portion extending upwardly from the safety blocking portion and spaced apart from the rear surface of the handgrip portion.

The mounting system may consist of mounting brackets adapted to be attached to the wall in spaced apart relation and received under the rail. Alternatively, the mounting system may have elongated brackets that extend lengthwise substantially coextensively with the rail. The elongated brackets may, for example, have a rail-supporting flange portion that extends out from the wall and is received either in a slot in the safety blocking portion or in a recess in the underside of the safety blocking portion.

In preferred embodiments, the handgrip portion, the safety blocking portion and, when included, the wall shield flange portion are unitary. A unitary rail can be made of a metal, such as aluminum, brass or stainless steel, a rigid polymeric material, such as polyvinyl chloride ("pvc"), a rigid structural foam polymeric material having a solid skin, such as pvc, or wood. The rail can be solid or hollow. It is also possible for the rail to have a structural base or retainer and a rail cover of a rigid polymeric material, such as pvc. Although the rail may have a textured surface, it is preferred that the surface be smooth so that it is easy to clean.

In some cases, the material of the rail is inherently impact resistant and provides good protection for the wall while retaining a good appearance after impacts from carts an other objects. Otherwise, for example when the rail is of wood or aluminum, the front surface of the handgrip portion may have a bumper insert of a suitable impact-resistant material, such as a rigid or semi-rigid polymeric material.

Walls are rarely absolutely flat. In order to avoid leaving gaps between a wall shield flange portion of the rail and the wall, the wall shield flange may have at its upper edge a flexible sealing lip that is adapted to engage the wall and to conform to irregularities in the wall. The sealing lip not only improves the appearance of the rail as installed but closes up any gaps where dirt can collect.

In embodiments of the present invention in which the rail includes a wall shield flange portion extending upwardly from the safety blocking portion and spaced apart from the rear surface of the handgrip portion, the mounting system may consist of elongated L-shaped brackets that extend substantially coextensively with the rail and have upper mounting flange portions received rearwardly of the wall shield portions in rear recesses of the wall shield portion. The upper flange portions receive fasteners, by which the brackets are attached to the wall. The mounting flange portions and fasteners are completely concealed by the wall shield portions of the rails.

The handgrip portion of the rail can have any shape in cross-section, such as round, rectangular with small-radius corners, or generally oval, that allows it to be grasped. It is preferred that the upper surface of the handgrip portion be shaped and dimensioned to conform substantially to a comfortably open palm of an outstretched hand of a person. For example, the upper, front and rear surfaces may form in cross-section a portion of an oval, modified to have a generally convex upper surface. A desirable configuration for the handgrip portion is an oval with a slightly convex upper surface and having a major dimension of about two inches and a minor dimension of about one inch. The wall shield flange portion, preferably, has an upper edge configured to engage the wall and a smoothly convexly curved frontal surface adjacent the upper edge. The rear surface of the handgrip portion should be spaced apart from the upper edge of the wall shield flange portion by about one and one-half inches to leave room for a user to grasp the rear edge with his or her fingers but to prevent a user's open palm or forearm from intruding into the space. The forearm can, in fact, nest comfortably in the gap between the handgrip portion and the upper curved frontal surface of the wall shield flange.

A handrail/leaning rail, according to the present invention, provides a handgrip that can be grasped by users who are able to do so but that also can be leaned on with an open palm or with the forearm by users who cannot or who choose not to grasp the handrail. The safety blocking portion of the rail prevents a user's hand or forearm from slipping into the gap that usually exists between previously known handrails and the wall and also provides a longitudinally continuous uniform surface, free from obtrusions, such as mounting brackets, that can catch a user's fingers. By having the rail separate from the mounting system, it is possible to adapt rails of various materials and configurations to the same mounting system, thus providing an architect or designer with the freedom to choose an esthetically pleasing rail system for the space in which the rail is installed. The separate mounting system also permits replacement of the rails, facilitates installation, and provides the possibility of fully concealed or hidden fasteners and, in the forms with L-shaped brackets, fully concealed mounts for the rails. The handrail/leaning rail of the present invention has the appearance of millwork, a residential look and is durable and easy to care for. Where provided, as is usually to be preferred, the wall shield flange portion of the rail protects the wall adjacent the handgrip from becoming soiled and eliminates a gap where dirt can collect. The wall shield flange portion is easy to keep clean, as compared to many wall surfaces.

DESCRIPTION OF THE DRAWINGS

For a more complete understanding of the present invention, and the advantages thereof, reference may be made to the following written description of exemplary embodiments, taken in conjunction with the accompanying drawings.

In most instances, corresponding parts and portions of all of the embodiments are assigned reference numerals having the same last two digits.

DESCRIPTION OF THE EMBODIMENTS

Figure 1:
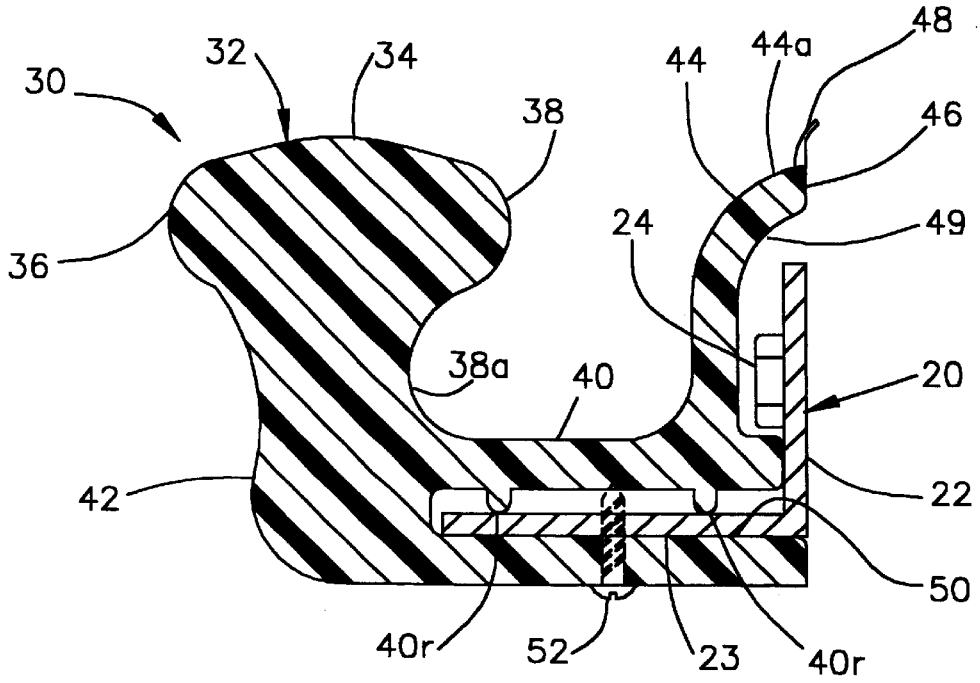
FIG. 1 is an end cross-sectional view of a first embodiment.

The first embodiment, shown in FIG. 1, has an elongated mounting bracket 20 of uniform cross section along its length. The bracket 20 is, preferably, of metal, such as aluminum or steel (a standard steel angle profile is possible), and has an upper mounting flange portion 22 that receives, for example, toggle bolts 24 that pass through a drywall into steel studs (not shown) or any suitable fastener by which a rail 30 is mounted on a wall. The rail 30 is of uniform cross-section along its length and has a handgrip portion 32 having an upper surface 34, an undercut front surface 36, and an undercut rear surface 38. The handgrip portion may be of any shape that is suitable for grasping. An oval-shape in cross section is preferred. The upper surface in the embodiment is slightly convexly curved, a shape that allows a comfortably open palm of an outstretched hand of a user who chooses to lean on the rail rather than grasp it to rest on the top surface. The curvature helps stabilize the user's hand against slipping off. The handgrip can be about two inches wide and one inch high.

A safety blocking portion 40 that is longitudinally coextensive with the handgrip portion extends toward the wall from the base 38*a* of the rear surface 38 of the handgrip portion 32. The blocking portion closes the gap that would otherwise exist between the handgrip portion and the wall, thereby preventing a user's hand or forearm from passing between the handgrip portion and the wall. It also presents a smooth, continuous surface, and eliminates any obstructions or irregularities along the rail on which a user's fingers might get caught. The frontal surface 42 below the handgrip portion and at the front of the safety blocking portion is smoothly contoured, preferably avoiding sharp corners, to provide both good function and appearance.

A wall shield flange portion 44 extends upwardly from the rear portion of the safety blocking portion 40 in a position to leave a space between it and the rear surface 38 of the handgrip portion 32 for the fingers of a user who grasps or leans on the rail. The upper edge 46 of the flange portion 44 is positioned to engage or to be very close to the wall. A flexible sealing lip 48 is formed with or attached to the upper edge so as to conform to any irregularities in the wall—one form of lip 48 is described below. The upper part of the shield flange portion has a smoothly convexly curved front surface 44*a*, which prevents discomfort to a user whose hand or forearm engages it. The surface 44*a* also forms with the surface 38 of the handgrip portion a nest in which a user can rest his or her forearm for support. The upper edge 46 is spaced apart from the rear extremity of the handgrip portion 38 by about one and one-half inches.

The shield flange portion 44 of the rail has a recess 49 in its rear surface which receives and fully conceals the mounting flange portion 22 of the bracket 20. The safety blocking portion 40 of the rail has a longitudinally continuous slot 50 that opens at the rear edge and receives and fully conceals a rail-supporting flange portion 23 of the bracket 20. Ribs 40*r* protrude into the slot and allow tolerance and alignment variations to occur without causing binding between the flange portion 23 and the slot 50. Screws 52, which are preferably self-tapping, that pass through the blocking portion 40 below the slot 50 and thread into the supporting flange portion 23 of the bracket 20 secure the rail 30 to the bracket 20. The screws are generally hidden from view and can, of course, be removed to permit replacement of the rail.

The rail 30 can be made of a metal, such as aluminum, brass, or stainless steel, a rigid polymeric material, such as a pvc extruded profile, a structural rigid foam polymeric material with a solid shell, such as an extruded pvc foam, or wood. An architect has considerable freedom to choose among possible materials for the rail.

Figure 2:
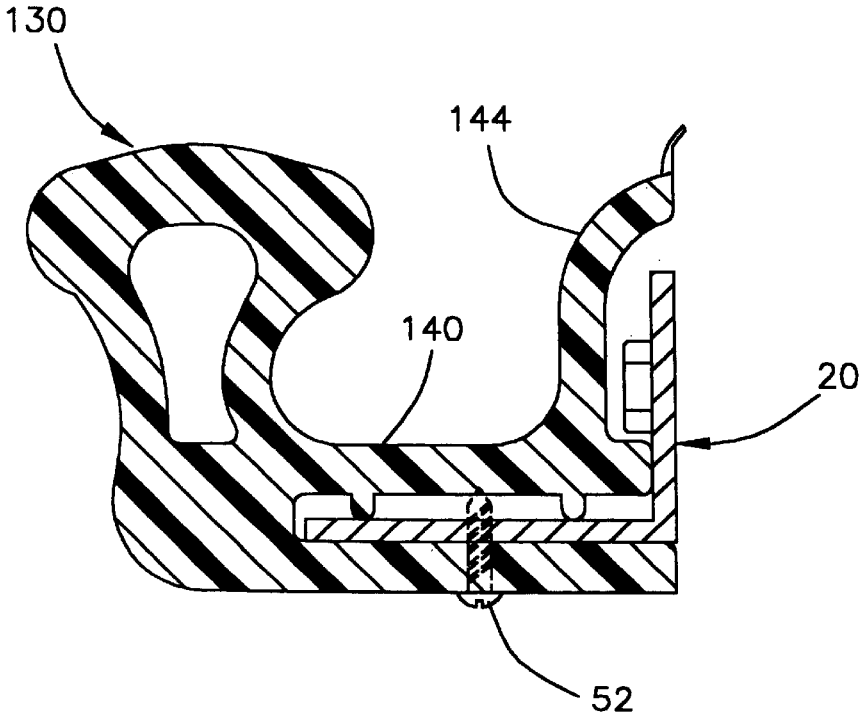
FIG. 2 is an end cross-sectional view of a second embodiment.

The embodiment of FIG. 2 is for the most part the same as that of FIG. 1, and the reference numerals in FIG. 2 are the same of those of FIG. 1, but increased by 100. The only difference is that the rail 130 is hollow.

Figure 3:
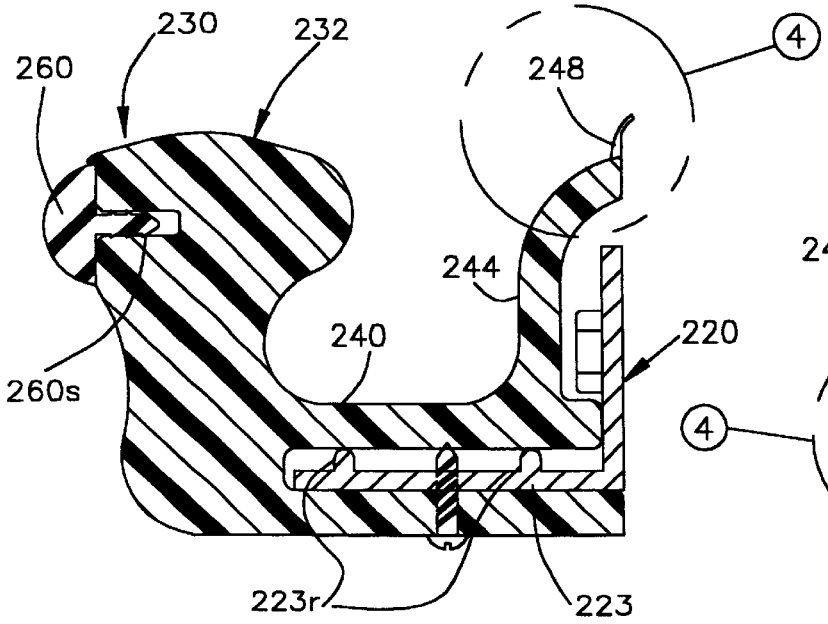
FIG. 3 is an end cross-sectional view of a third embodiment.

The third embodiment—FIG. 3, 200 series reference numerals applied—has a bumper insert 260 affixed to the front surface 236 of the handgrip portion 232 of the rail 230. The bumper insert is pre-formed of any suitable impact/mar-resistant material, which may be a rigid or semi-rigid polymeric material, such as pvc. The bumper insert is optional but is preferred if the rail is made of a material, such as wood, which can be marred or damaged by impacts. The bumper insert 260 is longitudinally coextensive with the rail 230 and has a serrated stem portion 260*s* that is received in a groove in the rail in an interference fit relationship. If desired or if necessary for secure affixation, an adhesive can be used to attach the bumper insert 260 to the handgrip portion of the rail.

In the embodiment of FIG. 3, the rail-supporting flange 223 of the bracket 220 has ribs 223*r* that allow for tolerance and alignment variations—the ribs 223*r* are functionally equivalent to the ribs 40*r* of the first and second embodiments. The ribs 40*r* and 223*r* can, of course, be relocated to the underside of the slot or bracket.

Figure 4:
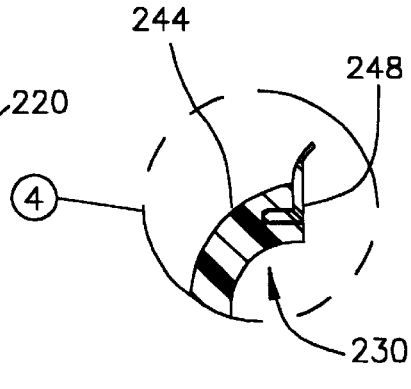
FIG. 4 is a fragmentary detail view of the portion of the third embodiment indicated by the circle 4 of FIG. 3.

FIG. 4 shows in detail a flexible sealing lip 248 which is preformed by extrusion of a semi-rigid polymeric material, such as pvc, and press-fitted into a groove in the upper edge portion of the wall shield flange portion 230. It is possible to form a sealing lip integrally with a rail of polymeric material. The sealing lip deforms elastically so as to conform with an irregular wall surface—most walls are not absolutely planar. With some walls, such as masonry walls, an adhesive caulk can be applied at the juncture of the upper edge of the wall shield flange portion of the rail with the wall. Some form of seal at that juncture is desirable to seal a gap where dirt and bacteria can otherwise intrude and be trapped.

Figure 5:
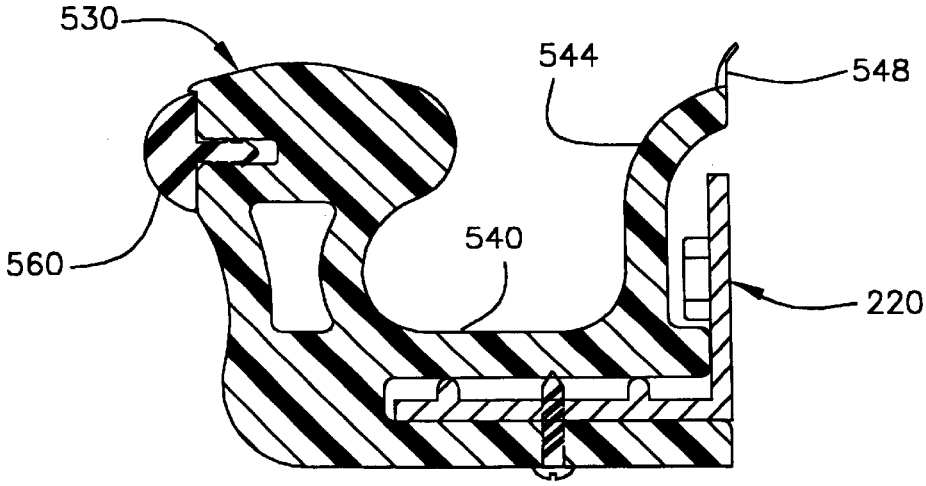
FIG. 5 is an end cross-sectional view of a fourth embodiment.

FIG. 5 shows a rail 530 like that of FIG. 3 but made hollow. Rails of either solid or foamed polymeric materials or of extruded metal can be hollow in order to save material costs.

Figure 6:
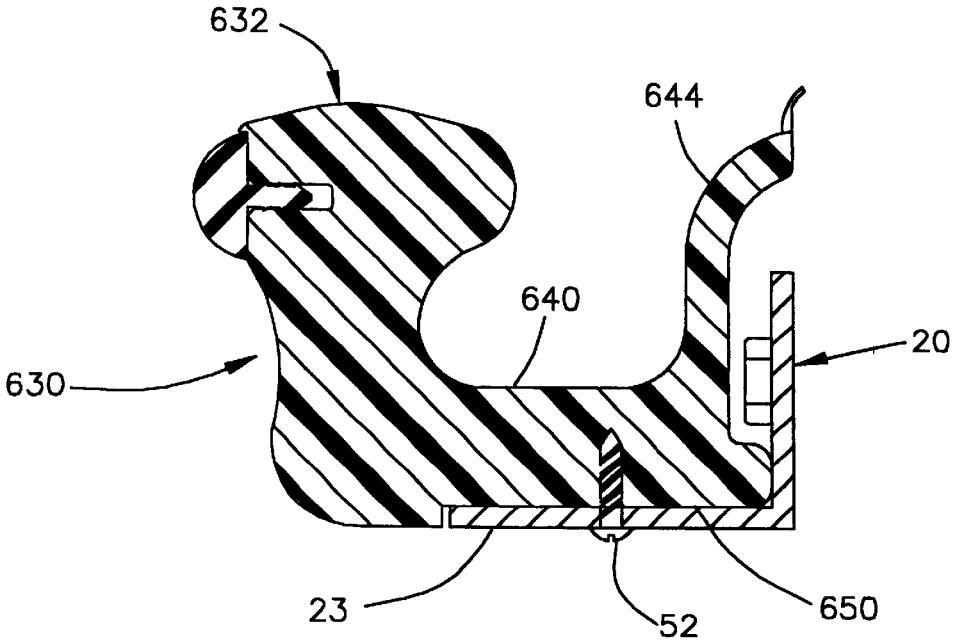
FIG. 6 is an end cross-sectional view of a fifth embodiment.

A suitable variation of the rail, shown in FIG. 6, is a rail having a recess 650 on the undersurface of the safety blocking portion 640. The rail 630 is mounted entirely on top of the supporting flange portion 23 of the bracket 20. The bracket cannot easily be seen, even though it is exposed on the underside of the rail. The screws 52 pass through the bracket and thread into the rail.

Figure 7:
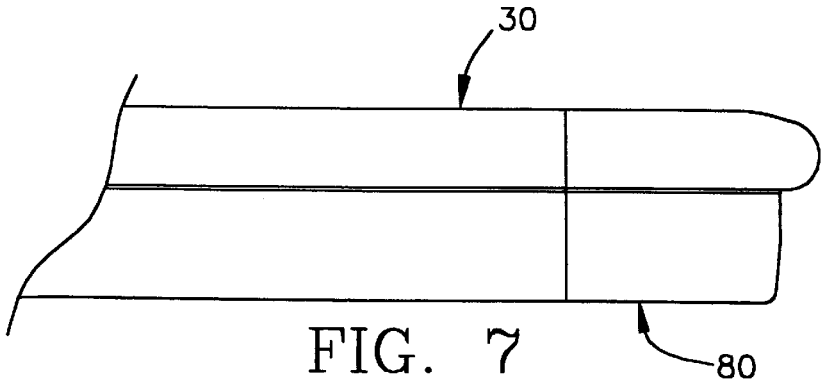
FIG. 7 is a front elevational view of an end portion of the first through fifth embodiments, which shows one form of treatment of the end of a rail section.
Figure 8:
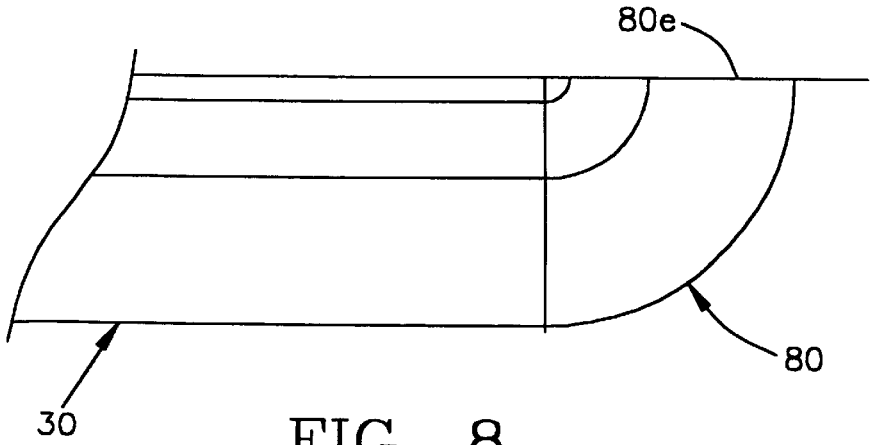
FIG. 8 is a top plan view of an end portion of the first to fifth embodiments, which includes the end cover of FIG. 7.

Like all good things, rails must come to an end, such as at door openings. FIGS. 7 and 8 show one form of treatment of the end of a rail section, namely, a molded or milled end piece 80 which is arcuate in plan (FIG. 8), has a cross-section along the arc that matches that of the rail 30, and has a planar free end 80*e* that engages or lies very close to the wall on which the rail is mounted. There are many ways of joining the end piece 80 to the rail 30. Also, the rail-supporting flange 23 of the bracket 20 can be extended to be received in a slot in the end piece or a recess on the underside of the end piece and screws used to fasten the end piece to the bracket.

Figure 9:
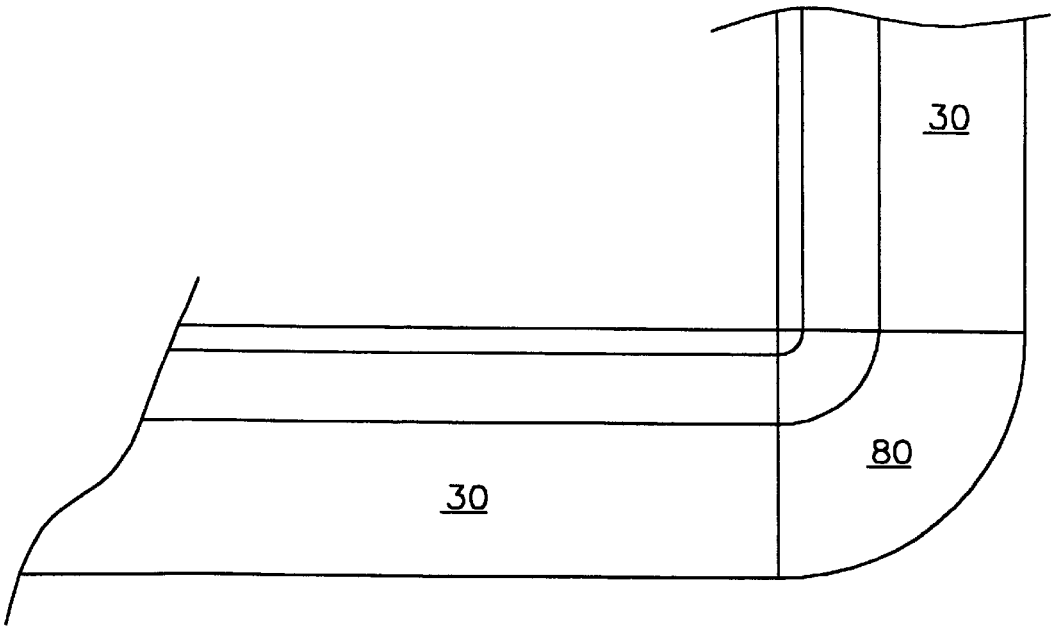
FIG. 9 is a top plan view of two sections of the first to fifth embodiments and shows one form of outside corner.

As shown in FIG. 9, the end piece 80 can also be used at an outside corner where two sections of rail 30 on the intersecting walls meet.

Figure 10:
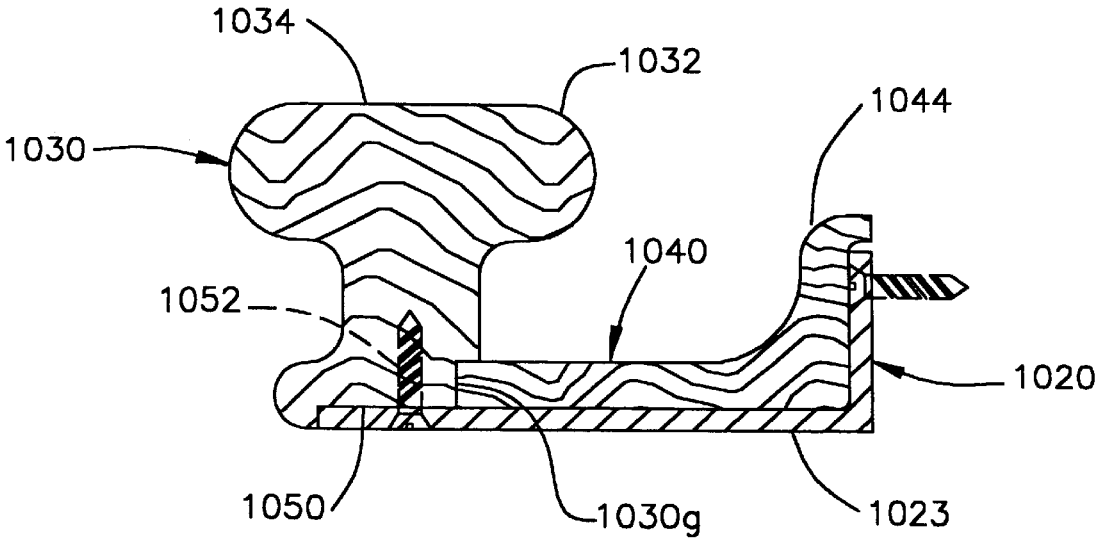
FIG. 10 is end cross-sectional view of a sixth embodiment.

The rail can be made of two or more pieces, which can yield cost-savings, for example, by reducing waste material milled away, without significantly impairing the function or appearance of the rail. A very simple structure is shown in FIG. 10. The mounting assembly is a metal angle 1020. The rail 1030 consists of a handgrip member 1032 and a safety blocking member 1040, a flange portion 1044 of which serves as a wall shield flange portion. A portion along the front edge of the blocking member 1040 is received and captured in a groove 1030*g* along the base of the handgrip member. The rail-supporting flange portion 1023 of the bracket 1020 is received in a recess 1050 on the undersurface of the handgrip member 1030, which is fastened to the flange portion 1023 by countersunk screws 1052 that thread into the handgrip member. The rail of FIG. 10 presents the interesting possibility of making the handgrip and the blocking members of different materials. The bracket and fasteners are well-hidden from view. The modified shape of the handgrip portion—flat upper surface 1034—and the shorter shield flange portion 1044 are indicative of various changes in the shape of the rail that are possible. The rail of FIG. 10 can be grasped or leaned on; the gap between the handgrip portion and the wall is blocked; the rail is easily cleaned, has a good appearance, includes a concealed bracket and concealed fasteners, and is inexpensive.

Figure 11:
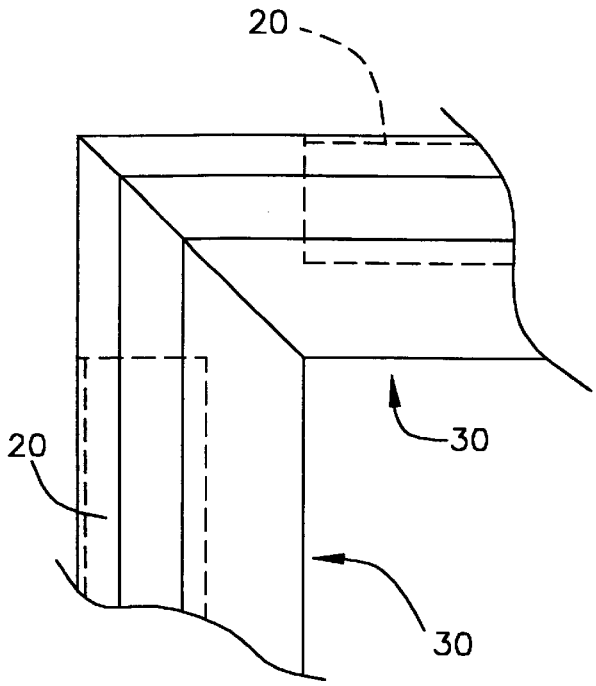
FIG. 11 is a top plan view of two sections of the first to sixth embodiments and shows the joint at an inside corner.
Figure 12:
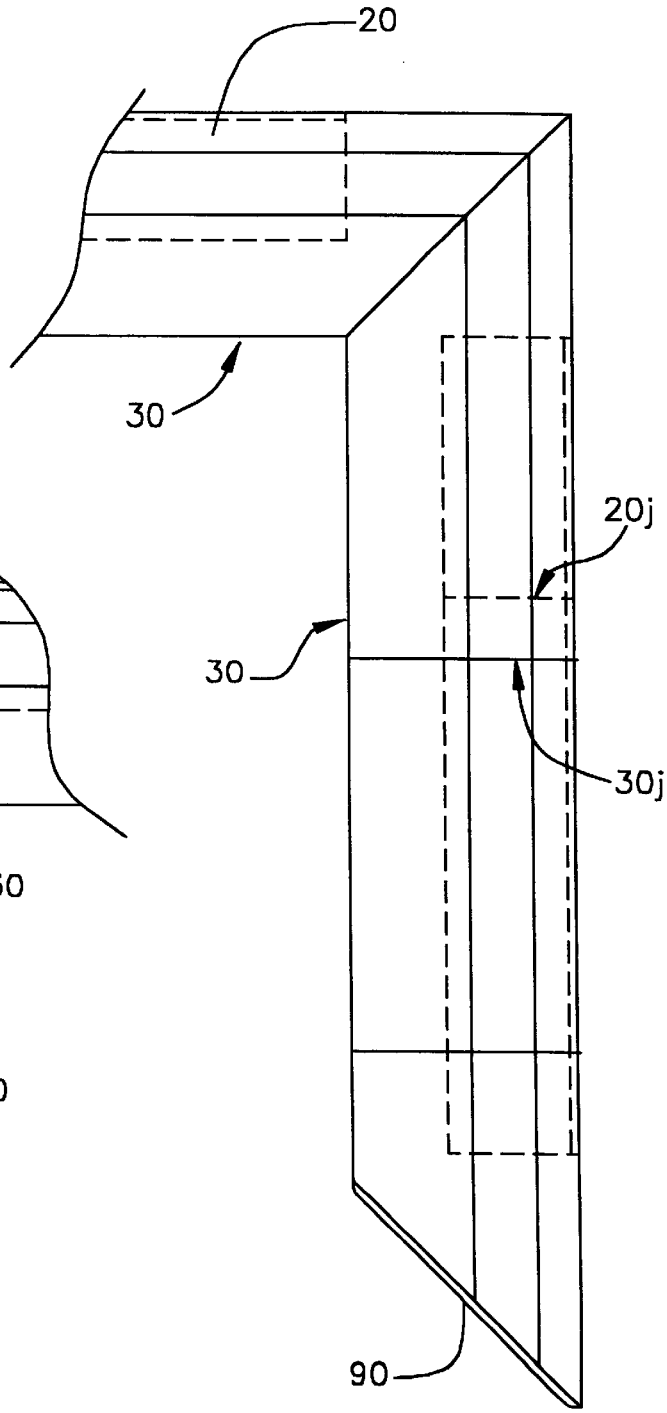
FIG. 12 is a top plan view of two sections of the first to sixth embodiments and shows an inside corner joint and another form of end piece at the end of the rail section.

FIGS. 11 and 12 show an inside corner joint between rail sections mounted on walls that intersect. It is simply a mitered joint, formed by cutting the ends of the rails 30 at 45 degree angles to their axes. Note that the brackets 20 can—but need not—end short of the joint. FIG. 12 reveals that it is desirable to form butt joints 20*j* between brackets 20 in a long rail section at a location spaced apart from a butt joint 30*j* between rail sections. The respective joints should not coincide. FIG. 12 also shows a treatment of the end of a rail section that is formed by cutting off the end of the rail 30 at an angle, such as 45 degrees, and affixing an end piece 90 in the form of a plate having a perimeter that matches the profile of the cut off cross-section at the end of the rail. (FIG. 14 shows the end piece 90 in elevation.)

Figure 13:
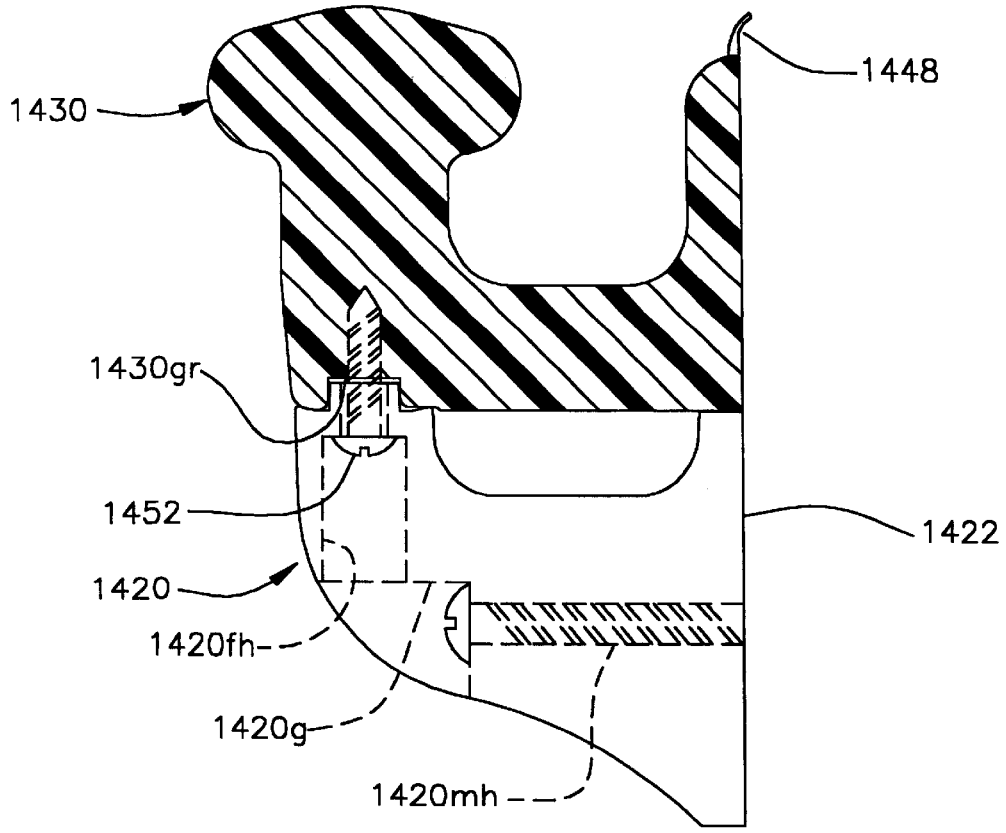
FIG. 13 is an end cross-sectional view of a seventh embodiment, in which the bracket system is based on spaced—apart brackets.
Figure 14:
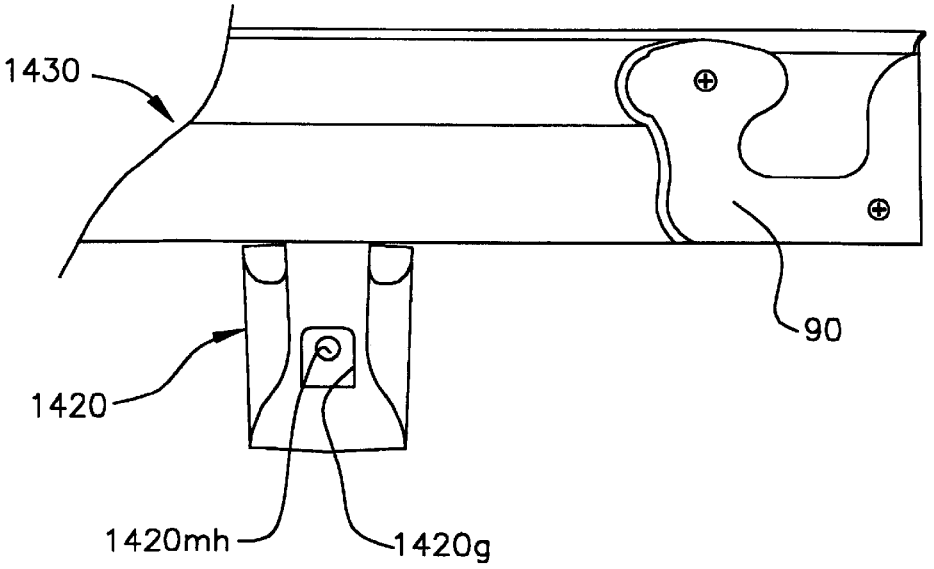
FIG. 14 is a front elevational view of an end portion of the seventh embodiment and shows one form of end piece for the end of a rail section.

Another suitable mounting system for handrail/leaning rails embodying the present invention is based on spaced—apart mounting brackets 1420, such as the one shown in FIGS. 13 and 14. Brackets of the type of FIGS. 13 and 14 are usually molded from a durable solid polymeric material, such as pvc. The bracket 1420 has a relative large mounting base 1422 so as to spread the load over the wall surface that it engages, a mounting hole 1420*mh* for a bolt by which the bracket is fastened to the wall, and a rail-fastening hole 1420*fh* for a screw 1452 by which the rail 1430 is fastened to the bracket 1430. The holes are accessible through a recess 1420*g* that opens frontally and inferiorly, which can either be left open or covered by a press-fit or snap-fit beauty plug (not shown). The exterior surface of the bracket can be of any desired shape as a matter of good appearance.

The rail 1430 of FIG. 13 is essentially the same as the one shown in FIG. 1, except that it does not have a recess in the rearward face or a slot for the a rail-supporting flange of a bracket 20. A groove 1430*gr* on the undersurface accepts a rib 1420*r* on the bracket. An integral sealing rib or a sealing rib insert 1448 seals any gaps between the rail and the wall.

Figure 15:
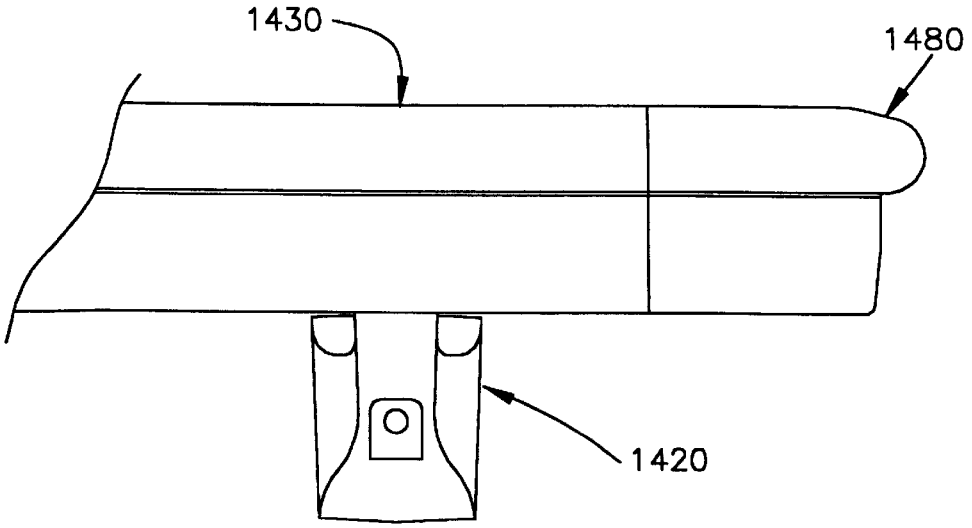
FIG. 15 is a front elevational view of an end portion of the seventh embodiment and shows another form of end piece.

As mentioned above, the end of a rail section, such as the rail 1430 of FIG. 13, can be cut off at an angle to the lengthwise axis and covered by an end plate 90 (FIG. 14) or cut off perpendicular to the lengthwise axis and covered by a curved molded or milled end piece 1480 (FIG. 15), which can also be used at an outside corner (see FIG. 9). Inside corners between the rails 1430 can have mitred joints (see FIGS. 11 and 12).

Figure 16:
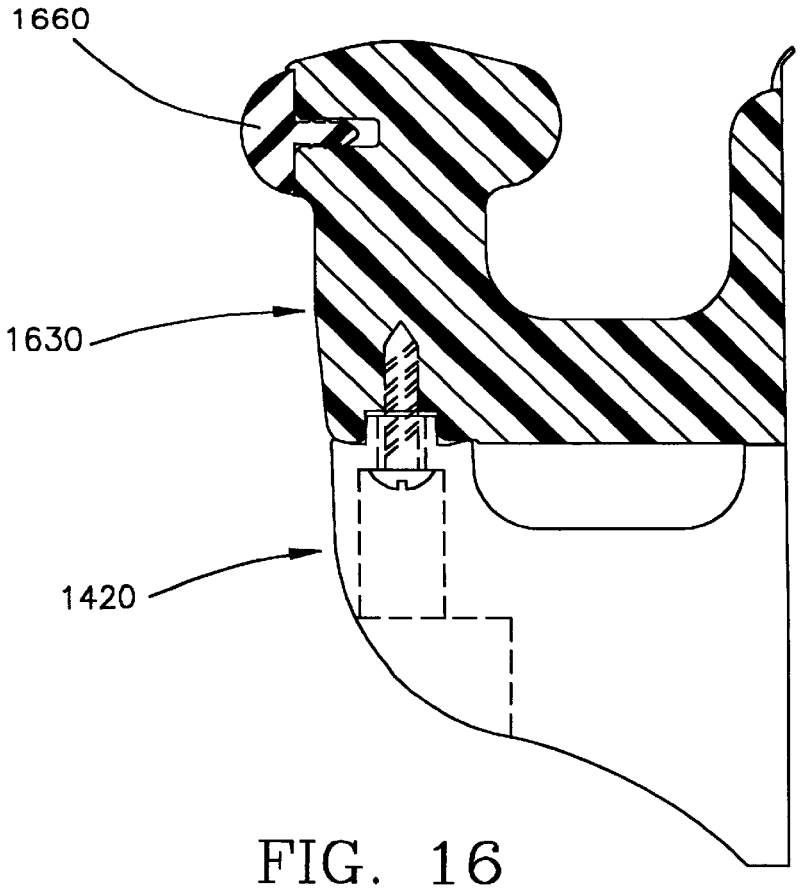
FIG. 16 is an end cross-sectional view of an eighth embodiment.
Figure 17:
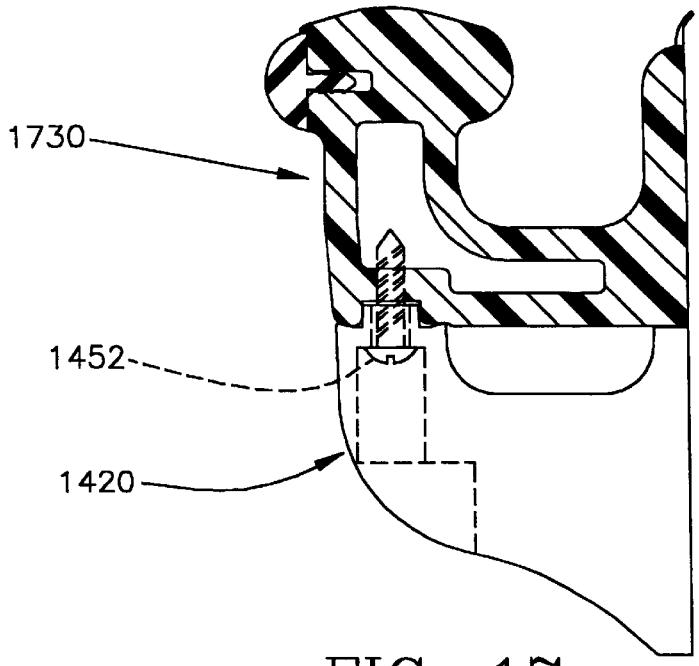
FIG. 17 is an end cross-sectional view of a ninth embodiment.

The embodiment of FIG. 16 is the same as that of FIG. 13, except that it has a bumper 1660 installed on the front surface of the rail 1630. A similar rail 1730, but hollow, is possible (FIG. 17).

Figure 18:
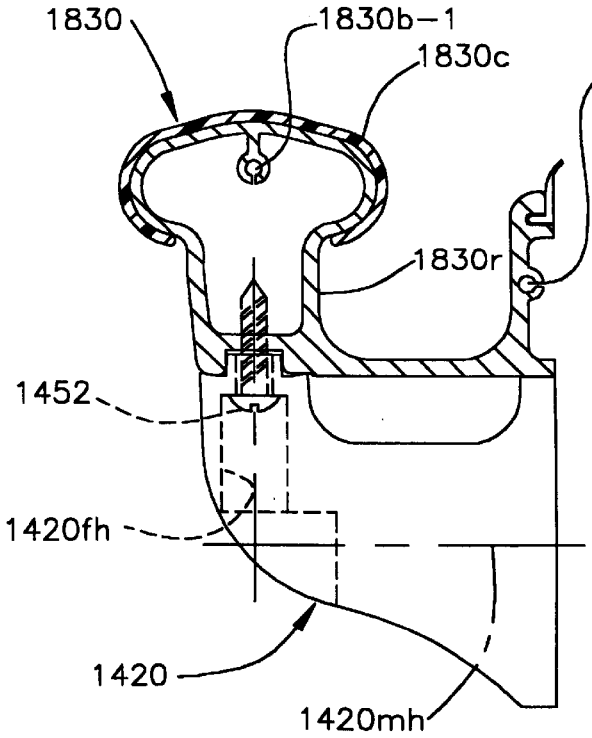
FIG. 18 is an end cross-sectional view of a tenth embodiment.
Figure 19:
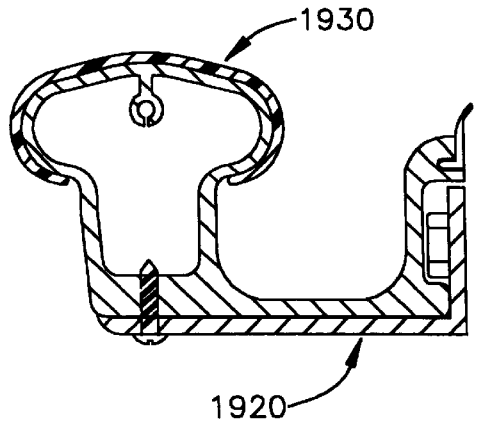
FIG. 19 is an end cross-sectional view of an eleventh embodiment.

Looking next at FIG. 18, a rail 1830 can also be composed of a structural base or retainer 1830*r* of extruded aluminum and a cover 1830*r* of a rigid, impact resistant polymeric material, such as pvc, which snaps on over the retainer and is retained by its resiliency. Rails and other wall protection products of that construction are known per se, such as the ACROVYN® wall protection products of Construction Specialties, Inc., the assignee of the present invention. Screw bosses 1830*b*-1 and 1830*b*-2 on the retainer allow for attachment of end pieces and corner pieces (not shown). The rail 1830 is designed for use with spaced-apart brackets 1420 received under the rail. A similar rail 1930, shown in FIG. 19, is designed for use with continuous elongated L-shaped mounting brackets 1920.

Figure 20:
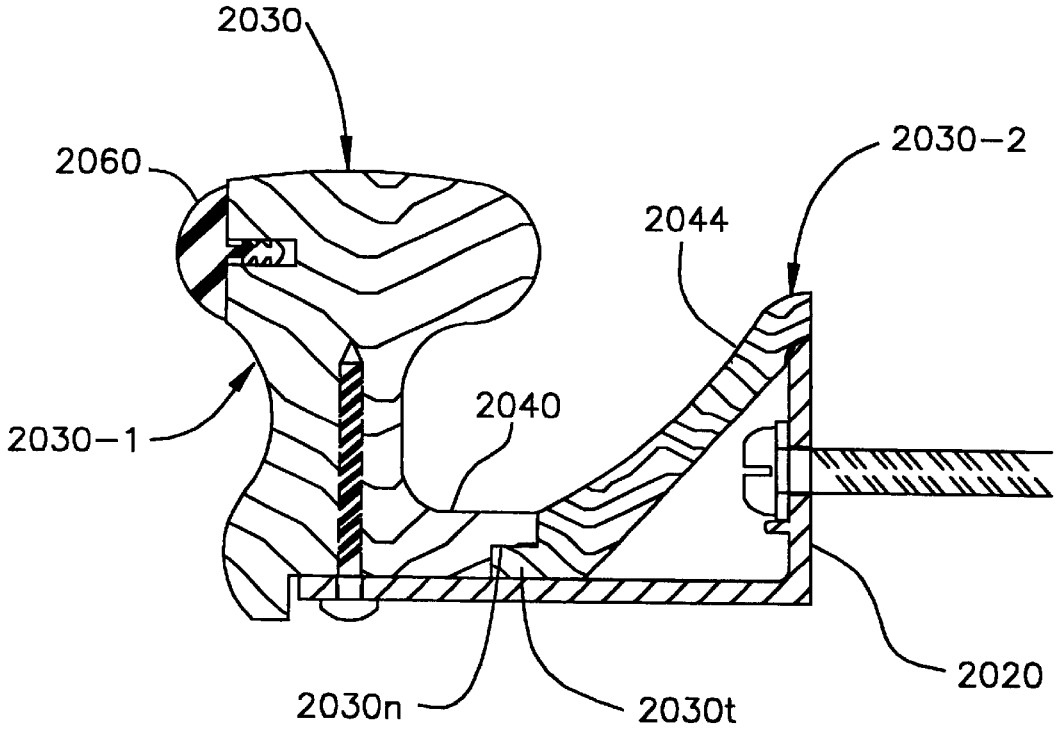
FIG. 20 is an end cross-sectional view of a twelfth embodiment.

The twelfth embodiment (FIG. 20) has a two piece rail 2030 that is supported on a longitudinally continuous L-shaped mounting bracket 2020, the rail-supporting flange 2023 of which is recessed into the underside of the rail 2030. A tongue 2030*t* on the lower front edge of a piece 2030-2 of the rail that forms a rear part of the safety blocking portion 2040 and the wall shield flange portion 2044 is captured in a notch 2030*n* of the handgrip piece 2030-1 of the rail 2030. The upper rear edge of the piece 2030-2 rests on the upper edge of the bracket 2020. The rail 2030 of the twelfth embodiment is well-suited for manufacture of wood.

It is possible, though perhaps a little less desirable than other possible arrangements because of a relatively sharp edge, to have mitred joints at an outside corner in all embodiments of the invention. An outside corner can also be treated by having beveled ends on the rails and cover plates (e.g., 90) concealing the ends. Rails of solid materials (solid metal, wood or plastic) that are not hollow and are mounted on spaced apart brackets (e.g. the rail of FIG. 13) can have beveled or rounded ends, which need not be covered.

What is claimed is:

1. A handrail/leaning rail comprising a mounting system adapted to be attached to a wall; and an elongated rail separate from the mounting system and removably attached to the mounting system and including a handgrip portion having a top surface and undercut front and rear surfaces and being shaped for grasping by a user, the rear surface being positioned on the rail to be spaced apart from the wall, a base portion below the handgrip portion and immediately adjacent the undercut surfaces of the handgrip portion, and a safety blocking portion longitudinally coextensive with the handgrip portion and the base portion and extending rearwardly from the base portion and having a rear edge proximate to the wall and below the rear surface such as to substantially block a space between the base portion and the wall and prevent a hand of a user from passing between the base portion and the wall.

2. A handrail/leaning rail according to claim 1 wherein the rail further includes a wall shield flange portion extending upwardly from the safety blocking portion and spaced apart from the rear surface of the handgrip portion.

3. A handrail/leaning rail according to claim 1 wherein the mounting system includes at least two mounting brackets adapted to be attached to the wall in spaced apart relation and received under the rail.

4. A handrail/leaning rail according to claim 1 wherein the mounting system includes an elongated bracket that extends substantially coextensively with the rail.

5. A handrail/leaning rail according to claim 4 wherein the elongated bracket includes a rail-supporting flange portion, the safety blocking portion has a slot opening generally rearwardly, and the rail-supporting flange portion is received in the slot.

6. A handrail/leaning rail according to claim 4 wherein the elongated bracket includes a rail-supporting flange portion, the underside of the safety blocking portion has a recess, and the rail-supporting flange portion is received in the recess.

7. A handrail/leaning rail according to claim 1 wherein the handgrip portion and the safety blocking portion are unitary.

8. A handrail/leaning rail according to claim 1 wherein the handgrip portion and the safety blocking portion are unitary and are of a material selected from the group consisting of a metal, a solid rigid polymeric material, a rigid foam polymeric material having a solid skin, wood, and combinations thereof.

9. A handrail/leaning rail according to claim 8 wherein the rail is hollow.

10. A handrail/leaning rail according to claim 8 wherein the rail includes a wall shield flange portion extending upwardly from the safety blocking portion and spaced apart from the rear surface of the handgrip portion, the wall shield flange portion having an upper edge configured to engage the wall.

11. A handrail/leaning rail according to claim 10 wherein the wall shield flange portion has a smoothly convexly curved frontal surface adjacent the upper edge.

12. A handrail/leaning rail according to claim 11 wherein the wall shield flange portion has at its upper edge a flexible sealing lip adapted to engage the wall.

13. A handrail/leaning rail according to claim 1 wherein the front surface of the handgrip portion has a bumper insert of an impact- and mar-resistant material.

14. A handrail/leaning rail according to claim 1 wherein the rail includes a wall shield flange portion extending upwardly from the safety blocking portion and spaced apart from the rear surface of the handgrip portion and the wall shield flange has at its upper edge a flexible sealing lip adapted to engage the wall.

15. A handrail/leaning rail according to claim 1 wherein the rail includes a wall shield flange portion extending upwardly from the safety blocking portion and spaced apart from the rear surface of the handgrip portion, and the mounting system includes an elongated L-shaped bracket that extends substantially coextensively with the rail and includes a mounting flange portion received rearwardly of the wall shield portion in a rear recess of the wall shield portion and a rail-supporting flange portion received in a recess in the safety blocking portion of the rail.

16. A handrail/leaning rail according to claim 1 wherein the rail includes a wall shield flange portion extending upwardly from the safety blocking portion and spaced apart from the rear surface of the handgrip portion, and the mounting system has an elongated L-shaped bracket that extends substantially coextensively with the rail and has a mounting flange portion received rearwardly of the wall shield portion in a rear recess of the wall shield portion, the mounting flange portion receives fasteners by which the brackets are attached to the wall, and the mounting flange portion and fasteners are completely concealed by the wall shield portion of the rail.

17. A handrail/leaning rail according to claim 1 and further comprising a molded or milled end piece which is arcuate in plan, has a cross-section along the arc that matches that of the rail, and has a planar free end that engages or lies very close to the wall on which the rail is mounted.

18. A handrail/leaning rail according to claim 17 wherein the end piece forms an outside corner where two sections of rail on intersecting walls meet.

19. A handrail/leaning rail according to claim 1 wherein two rail sections meet at a mitred inside corner.

20. A handrail/leaning rail according to claim 1 wherein two rail sections meet at a mitred outside corner.

21. A handrail/leaning rail according to claim 1 a rail section has an end termination formed by cutting the rail at an angle oblique to a longitudinal axis of the rail.

22. A handrail/leaning rail according to claim 21 wherein the end termination is covered by an end piece in the form of a plate having a perimeter that matches the profile of the cut off cross-section at the end of the rail.

23. A handrail/leaning rail according to claim 1 wherein the upper surface of the handgrip portion of the rail is shaped and dimensioned to conform substantially to a comfortably open palm of an outstretched hand of a person.

24. A handrail/leaning rail according to claim 23 wherein the upper, front and rear surfaces of the handgrip portion form in cross section a portion of an oval.

25. A handrail/leaning rail according to claim 24 wherein the oval has a major dimension of about two inches and a minor dimension of about one inch.

26. A handrail/leaning rail according to claim 23 wherein the rail includes a wall shield flange portion extending upwardly from the safety blocking portion and spaced apart from the rear surface of the handgrip portion, the wall shield flange portion having an upper edge configured to engage the wall and a smoothly convexly curved frontal surface adjacent the upper edge.

27. A handrail/leaning rail according to claim 26 wherein the rear surface of the handgrip portion is spaced apart from the upper edge of the wall shield flange portion by about one and one-half inches.

* * * * *

UNITED STATES PATENT AND TRADEMARK OFFICE

CERTIFICATE OF CORRECTION

PATENT NO. : 6,270,058 B1
DATED : August 7, 2001
INVENTOR(S) : Williams et al.

It is certified that error appears in the above-identified patent and that said Letters Patent is hereby corrected as shown below:

Column 1,
Line 33, “accidently” should read -- accidentally --

Column 4,
Line 22, “spaced—apart” should read -- spaced-apart --

Column 7,
Line 16, “spaced—” should read -- spaced --
Line 26, “inferiorly” should read -- interiorly --
Line 50, “1830*r*” should read -- 1830*c* --

Column 8,
Line 6, “of” should read -- from --

Column 10,
Line 9, “mitred” should read -- mitered --
Line 11, “mitred” should read -- mitered --

Signed and Sealed this

Twenty-eighth Day of January, 2003

JAMES E. ROGAN
*Director of the United States Patent and Trademark Office*